US008517221B2

(12) United States Patent
Sweeton et al.

(10) Patent No.: US 8,517,221 B2
(45) Date of Patent: Aug. 27, 2013

(54) TRIGGER SPRAYER

(75) Inventors: Steven L. Sweeton, Lake Winnebago, MO (US); George R. Hildebrand, Independence, MO (US); David L. Dejong, Ogden, UT (US); Phillip J. Dimaggio, Kansas City, MO (US)

(73) Assignee: MeadWestvaco Corporation, Richmond, VA (US)

( * ) Notice: Subject to any disclaimer, the term of this patent is extended or adjusted under 35 U.S.C. 154(b) by 922 days.

(21) Appl. No.: 12/517,387

(22) PCT Filed: Dec. 7, 2007

(86) PCT No.: PCT/US2007/086722

§ 371 (c)(1),
(2), (4) Date: Dec. 17, 2009

(87) PCT Pub. No.: WO2008/073809

PCT Pub. Date: Jun. 19, 2008

(65) Prior Publication Data

US 2010/0140299 A1 Jun. 10, 2010

Related U.S. Application Data

(60) Provisional application No. 60/869,212, filed on Dec. 8, 2006.

(51) Int. Cl.

| | |
|---|---|
| ***B65D 37/00*** | (2006.01) |
| ***B67B 1/00*** | (2006.01) |
| ***B67D 7/58*** | (2010.01) |
| ***B05B 9/043*** | (2006.01) |
| ***A62C 11/00*** | (2006.01) |

(52) U.S. Cl.
USPC ..... 222/207; 222/153.13; 222/383.1; 239/333

(58) Field of Classification Search
USPC ..... 222/207, 383.1, 153.13; 239/571, 239/525, 526, 337, 333, 362, 363
See application file for complete search history.

(56) References Cited

U.S. PATENT DOCUMENTS

| | | | | | |
|---|---|---|---|---|---|
| 3,685,739 | A | * | 8/1972 | Vanier | 239/333 |
| 3,726,442 | A | * | 4/1973 | Davidson et al. | 222/207 |
| 3,749,290 | A | * | 7/1973 | Micallef | 222/207 |
| 4,033,487 | A | | 7/1977 | Micallef | |
| 4,506,805 | A | * | 3/1985 | Marcon | 222/153.13 |
| 4,618,077 | A | | 10/1986 | Corsette | |
| 4,747,523 | A | * | 5/1988 | Dobbs | 222/383.1 |
| 4,880,161 | A | * | 11/1989 | Wright | 239/330 |
| 5,114,052 | A | * | 5/1992 | Tiramani et al. | 222/207 |
| 5,156,304 | A | * | 10/1992 | Battegazzore | 222/341 |

(Continued)

*Primary Examiner* — Paul R Durand
*Assistant Examiner* — Vishal Pancholi
(74) *Attorney, Agent, or Firm* — MeadWestvaco Intellectual Property Group

(57) ABSTRACT

A trigger sprayer having six parts: (i) a dip tube, (ii) a valve, (iii) a flexible pump diaphragm having a circumferential valve lip, (iv) a shroud having a trigger, an element which engages the diaphragm, and front and rear mating elements, (v) a body having a closure for a container, an inlet coupled to the dip tube, a valve seat for the valve, an element which engages the valve lip, a discharge barrel having a proximal opening into which the valve lip seats, a vent chamber, a vent barrel coupled to the vent chamber, a rear mating structure coupling to the rear mating element of the shroud so that the shroud can pivot, and a forward mating element, and (vi) a combination nozzle and door assembly with a nozzle which couples to the fluid discharge barrel of the molded body, and has a trigger locking element.

9 Claims, 18 Drawing Sheets

(56) References Cited

U.S. PATENT DOCUMENTS

| | | | | |
|---|---|---|---|---|
| 5,722,569 | A * | 3/1998 | Foster | 222/153.13 |
| 5,823,395 | A * | 10/1998 | Foster et al. | 222/153.02 |
| 5,884,845 | A | 3/1999 | Nelson | |
| 6,168,050 | B1 * | 1/2001 | Battegazzore | 222/207 |
| 6,364,171 | B1 * | 4/2002 | Chalupsky et al. | 222/321.8 |
| 6,364,174 | B1 * | 4/2002 | Lohrman et al. | 222/383.1 |
| 6,527,202 | B1 * | 3/2003 | Tseng | 239/333 |
| 6,637,626 | B1 | 10/2003 | Bloom | |
| 6,851,625 | B1 * | 2/2005 | Kuo | 239/333 |
| 2004/0222243 | A1 * | 11/2004 | Sweeton | 222/383.1 |

* cited by examiner

TRIGGER SPRAYER

CROSS-REFERENCE TO RELATED APPLICATIONS

This application claims the benefit of U.S. Provisional Application Serial Number 60/869,212, filed Dec. 8, 2006.

BACKGROUND OF THE INVENTION

1. Field of the Invention

This invention relates broadly to hand-held and hand-operated liquid sprayers typically called trigger sprayers.

2. State of the Art

A common trigger sprayer may be seen with reference to commonly-owned U.S. Pat. No. 4,747,523 to Dobbs. The trigger sprayer of Dobbs is seen to be comprised of numerous parts including (i) a pump housing or body having a pump chamber, (ii) an inlet passageway and an outlet passageway, (iii) a closure cap which mounts the pump body to a container, (iv) a dip tube coupled to the inlet passageway, (v) a check (ball) valve in the inlet passageway, (vi) a trigger which mounts to and rotates relative to the pump housing, (vii) a pump piston which is actuated by the trigger, (viii) a coil spring seated in the pump chamber, (ix) a discharge valve located at the entrance of the outlet passageway, (x) a nozzle coupled to the outlet passageway of the pump body, and (xi) a shroud which covers the pump housing. The trigger sprayer of Dobbs includes additional elements as parts of the above-listed elements. For example, the pump piston of Dobbs includes chevron seals for sealing against the pump chamber and for acting as a vent port seal. Many trigger sprayers include additional parts to implement venting. Likewise, many sprayers utilize additional parts in the nozzle to implement spraying options.

SUMMARY OF THE INVENTION

A functional trigger sprayer according to the invention has only six easily assembled parts. In a preferred embodiment the six parts of the trigger sprayer of the invention include (i) a dip tube, (ii) a ball valve, (iii) a molded flexible pump diaphragm having a circumferential flange and a valve lip, (iv) a molded shroud which includes a trigger, an actuation element which engages the pump diaphragm, a front mating element, a rear mating element, (v) a molded body having a closure for a container, a fluid inlet coupled to the dip tube, a valve seat for the ball valve, an engaging element for engaging the circumferential flange of the flexible diaphragm, a fluid discharge barrel having a proximal opening into which the valve lip of the pump diaphragm seats, a vent chamber, a vent barrel coupling the vent chamber to the ambient atmosphere, a body section having a mating element for coupling to the rear mating element of the shroud so that the shroud can pivot at the coupling point, and a forward mating element, and (vi) a molded combination nozzle and door assembly with a nozzle which couples to the fluid discharge barrel of the molded body and a flange which mates with the forward mating element of the body, a live hinge, and a door having a first plug which plugs the nozzle, a second plug which plugs the vent barrel, and trigger locking elements which mate with the front mating element of the molded shroud in order to lock the trigger when the door is closed.

In the preferred embodiment, the integral trigger shroud has a forward finger trigger, two shroud arms which extend rearwardly from their front mating elements which are adjacent the nozzle and can be locked by the trigger locking elements of the door arms, an upper shroud portion which joins the shroud arms and includes downwardly directed actuation ribs for engaging the diaphragm, and rear trunnions which snap into the valve body so that the entire trigger shroud can pivots relative to the body. Thus, pushing backward on the trigger will cause the trigger shroud to pivot about the rear trunnions slightly downward, which will in turn cause the actuation ribs to depress the pump diaphragm. When the trigger is released, the elasticity of the pump diaphragm will cause movement of the trigger shroud back to its at-rest position.

With the entire trigger sprayer having only six pieces including the ball, the dip tube, and four molded pieces, assembly of the trigger sprayer is simple and overall costs are reduced. Assembly may be accomplished in five simple steps: placing the ball valve into the body; snapping the diaphragm into the body; snapping the trigger trunnions into the valve body with the trigger shroud over the diaphragm; snapping the nozzle and door assembly into the valve body; and pushing the dip tube into the body.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1A:
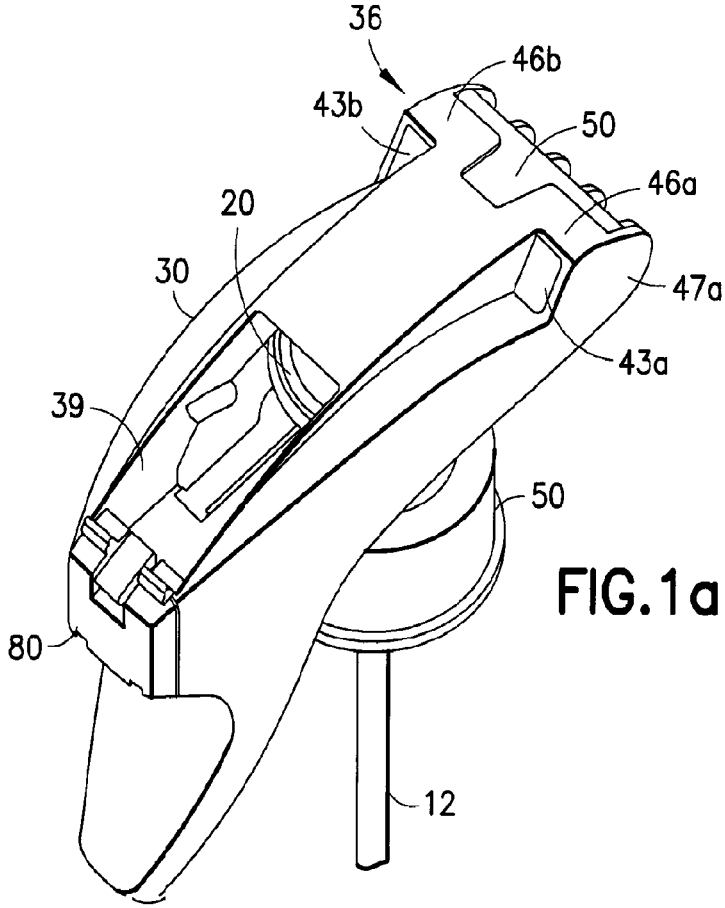
FIG. 1*a* is a front perspective view of the trigger sprayer of the invention.

Turning now to FIGS. 1*a*-1*d*, a trigger sprayer 10 having six easily assembled parts is provided. In a preferred embodiment the six parts of the trigger sprayer 10 include a dip tube 12, a ball valve 14, a flexible pump diaphragm 20, a molded combination trigger shroud 30, a molded body 50, and a molded combination nozzle and door assembly 80. As seen best in FIG. 1*d*, the dip tube 12 is coupled to the molded body 50, the ball valve 14 sits in the molded body 50, the diaphragm 20 sits atop the molded body 50, and the combination nozzle and door assembly 80 is coupled to the molded body 50. As seen best in FIGS. 1*a* and 1*b*, the shroud trigger 30 mates with the body 50.

Figure 2A:
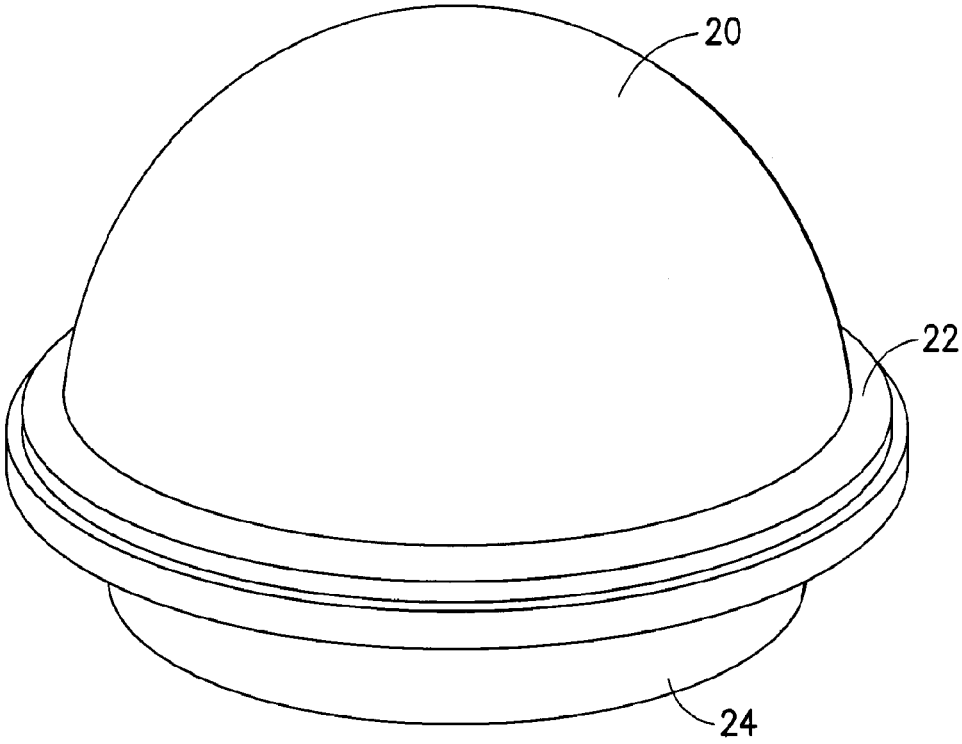
FIG. 2*a* is a perspective view of the diaphragm of FIGS. 1*c* and 1*d*.
Figure 2B:
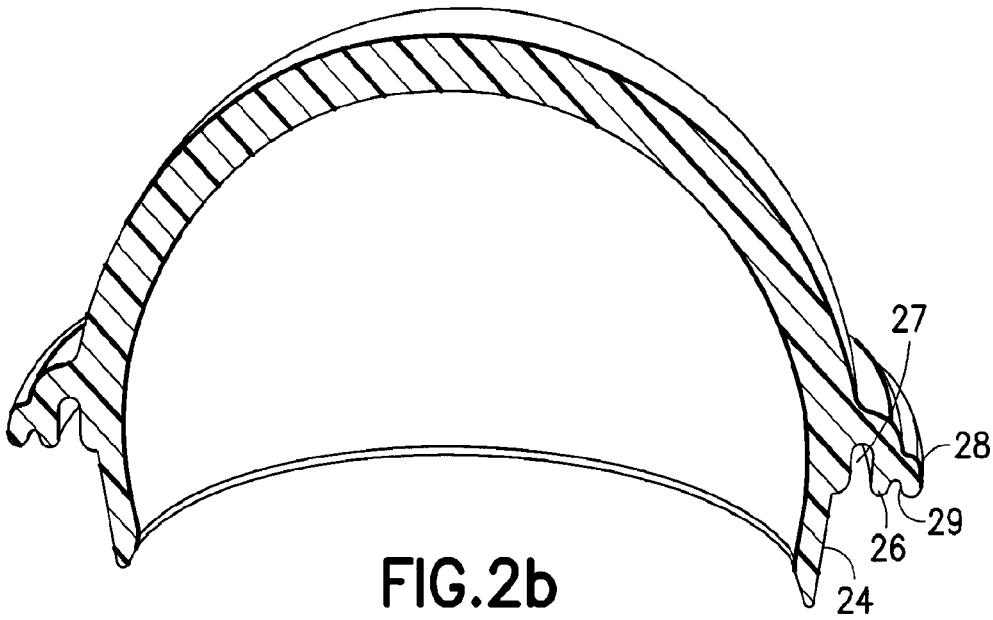
FIG. 2*b* is a cross-sectional perspective view of the diaphragm of FIG. 2*a*.
Figure 3A:
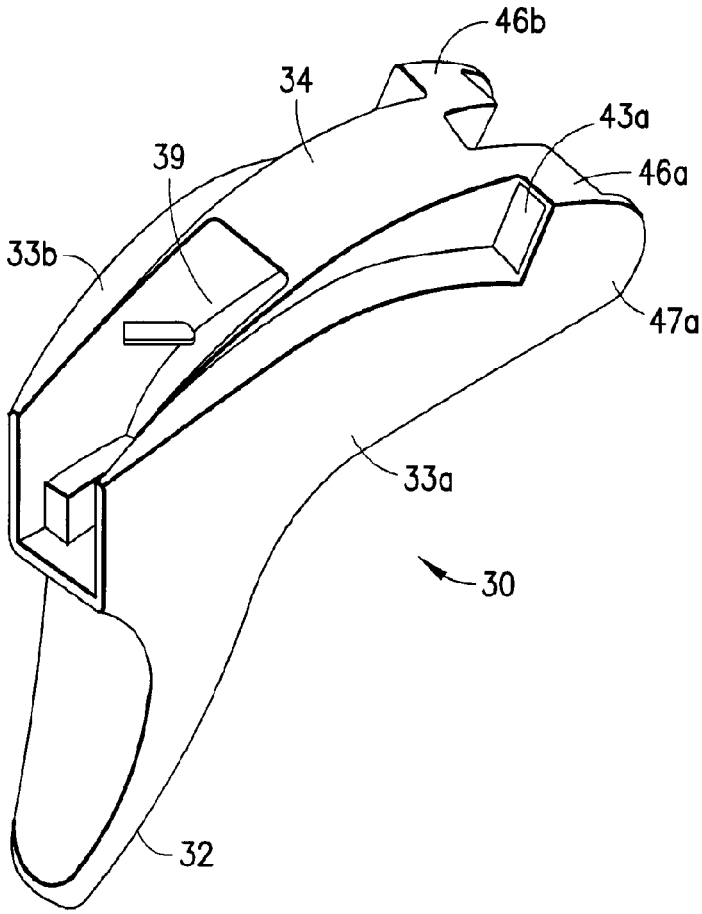
FIG. 3*a* is a perspective view of the trigger shroud of FIG. 1*a*.
Figure 3B:
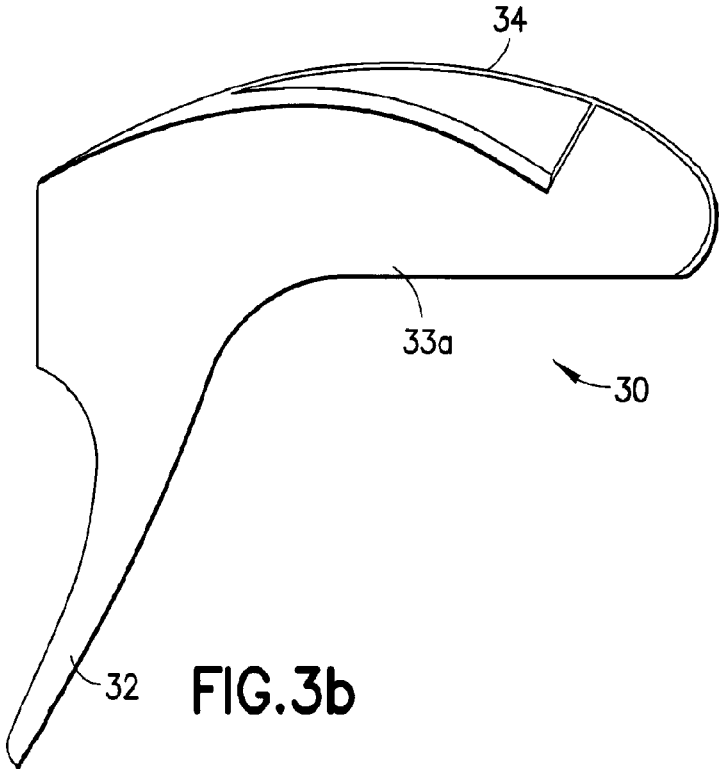
FIG. 3*b* is a side elevation view of the trigger shroud of FIG. 3*a*.
Figure 3D:
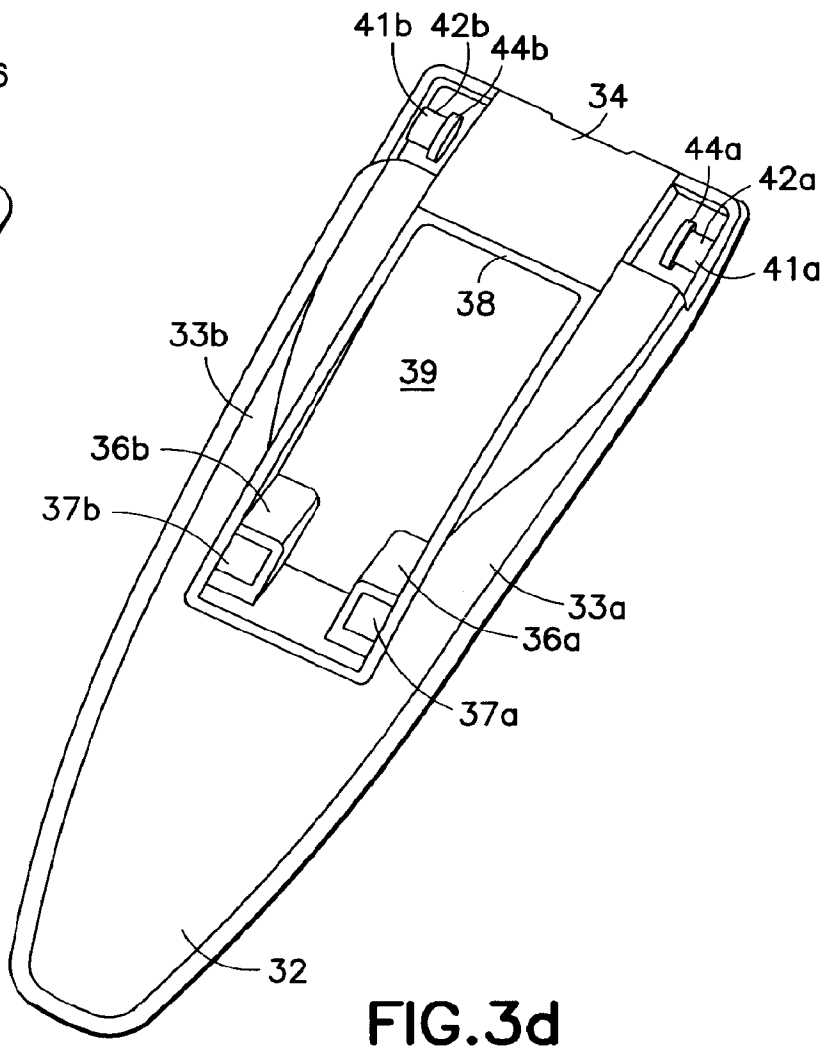
FIG. 3*d* is a top perspective view of the trigger shroud of FIG. 3*a*.
Figure 3C:
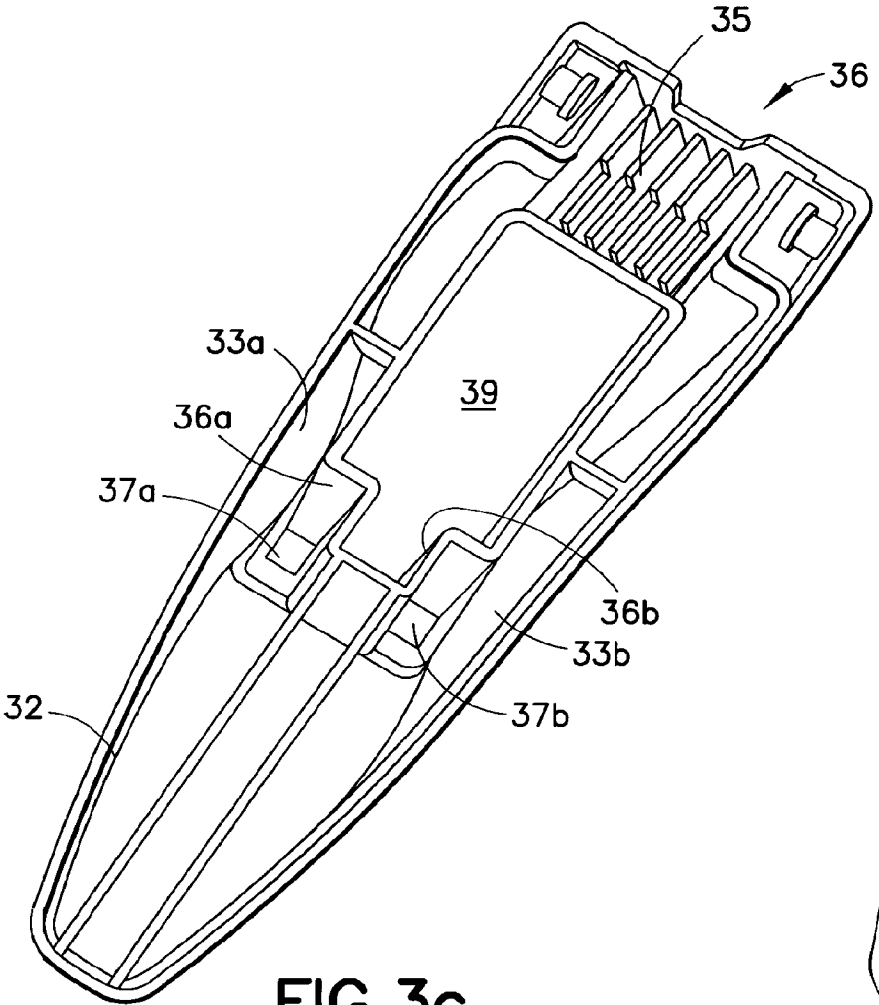
FIG. 3*c* is a bottom perspective view of the trigger shroud of FIG. 3*a*.

Turning now to FIGS. 2*a* and 2*b*, the molded flexible pump diaphragm 20 is shown with a circumferential flange 22 and a valve lip or skirt 24. The diaphragm 20 is preferably formed from a copolymer ELVALOY (a trademark of DuPont), although other materials could be utilized such as by way of example only and not by way of limitation ethylene copolymers or acrylate copolymers. In an at rest position the diaphragm is a generally hemispherical body. The circumferential flange 22 essentially constitutes a double tongue and groove seal. More particularly, flange 22 has a first finger or tongue 26 which defines a first recess or groove 27 between the finger 26 and the diaphragm body, and a second finger or tongue 28 which defines a second recess or groove 29 between the first finger 26 and the second finger 28. As described hereinafter, the recesses receive corresponding elements of the molded body 50 which help hold the diaphragm 20 in place. The open end of the hemispherical body constitutes the valve lip or skirt 24, which as hereinafter described, at least partially sits in a fluid path and acts as a valve therein.

Figure 1B:
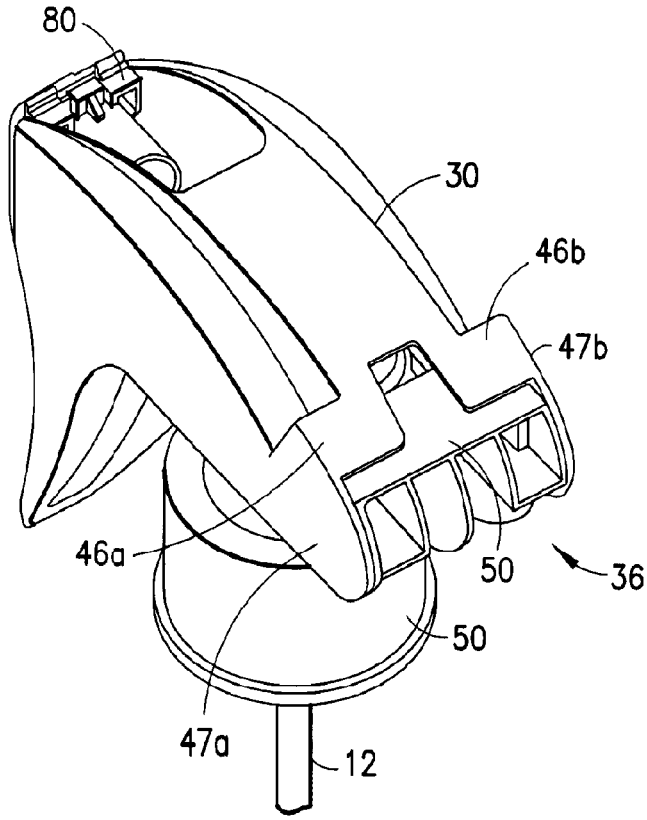
FIG. 1*b* is a rear perspective view of the trigger sprayer of FIG. 1*a*.
Figure 1C:
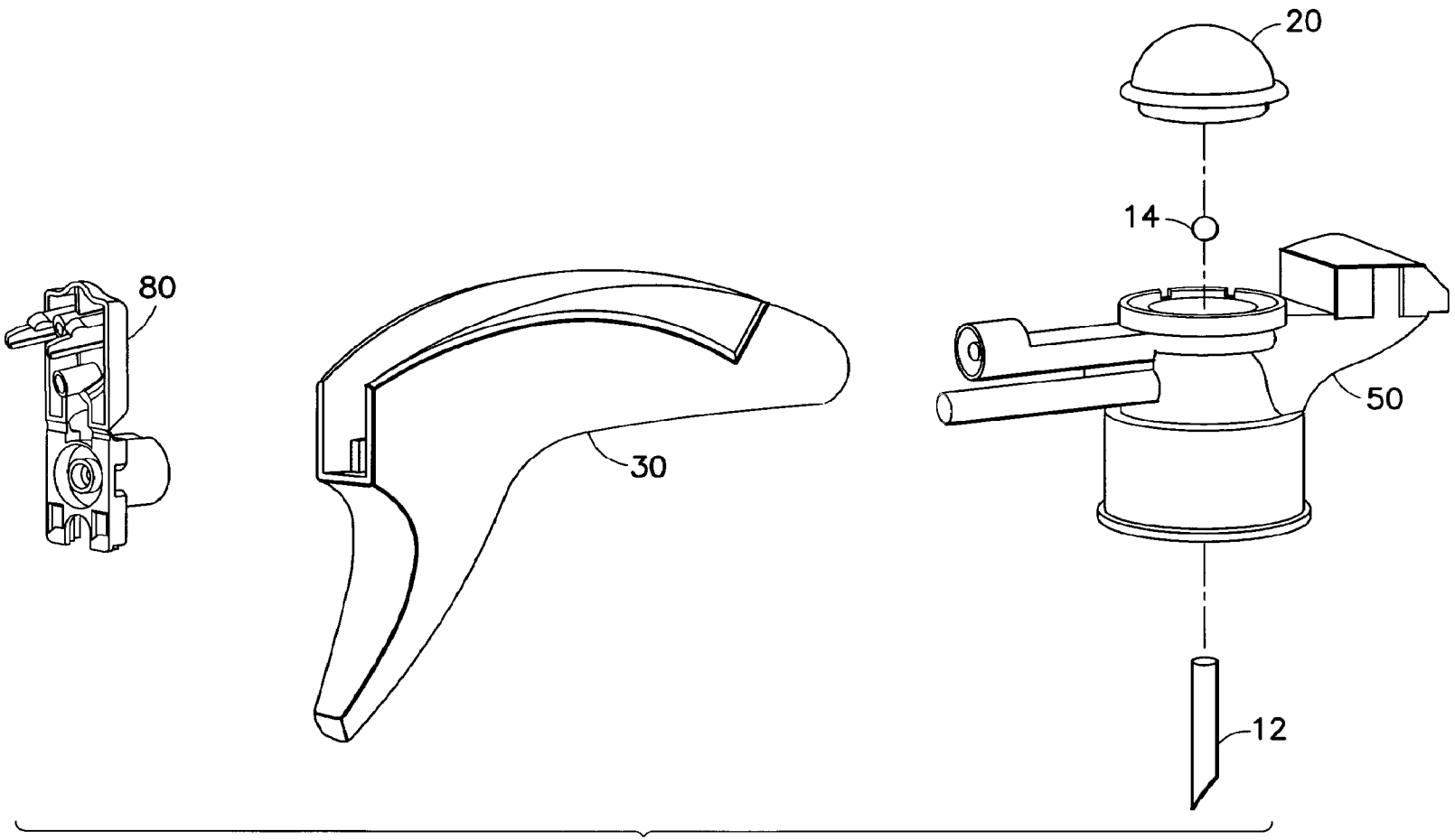
FIG. 1*c* is an exploded view of the trigger sprayer of FIG. 1*a*.
Figure 1D:
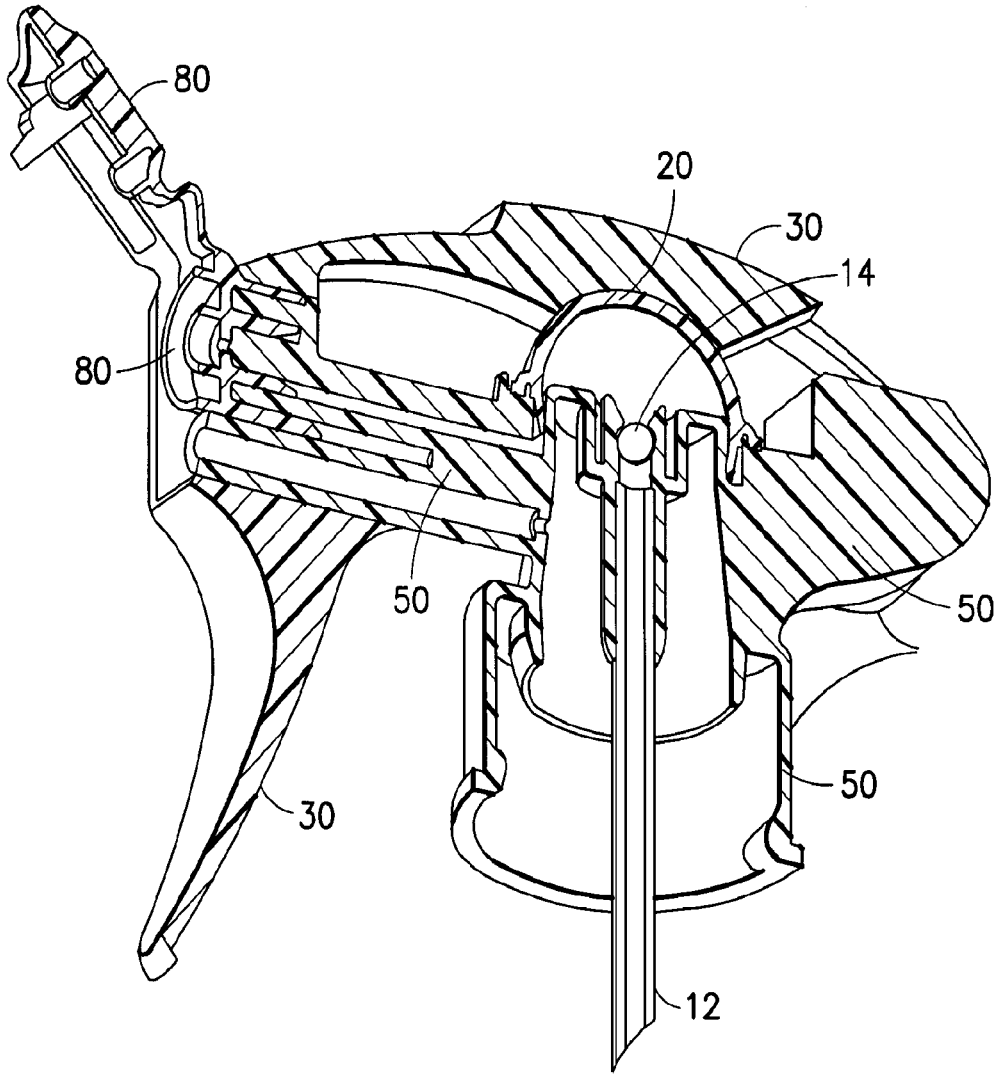
FIG. 1*d* is a cross-sectional perspective view of the trigger sprayer of FIG. 1*a*.

Referring now to FIGS. 3*a* through 3*d*, the combination trigger shroud 30 in a preferred embodiment is an integral piece of polypropylene, although other materials could be utilized such as by way of example only and not by way of limitation high density polyethylene (HDPE). The trigger shroud 30 has finger trigger 32 located at the nozzle end of the trigger sprayer 10, two shroud arms 33*a*, 33*b*, an upper shroud portion 34 which joins the shroud arms 33*a*, 33*b* and includes on its underside (FIG. 3*c*) downwardly directed actuation ribs 35 for engaging the top of the diaphragm 20, and a rear section 36 defined by the arms 33*a*, 33*b* and the upper shroud portion 34. The forward portion of the shroud arms 33*a*, 33*b* extend above the finger trigger 32 and are provided with front locking elements 36*a*, 36*b* (see FIGS. 3*c* and 3*d*) which define trigger lock windows 37*a*, 37*b*. The front locking elements are adjacent the nozzle (as described hereinafter) and can be locked by the trigger locking elements of the door arms (as also hereinafter described). The shroud arms and the front edge 38 of the upper shroud portion 34 also define an opening 39 above the body 50. Turning to FIGS. 1*a* and 1*b* in conjunction with FIGS. 3*a*-3*d*, the rear section 36 of the trigger shroud 30 includes rear engagement elements, preferably in the form of trunnions 41*a*, 41*b*. The trunnions 41*a*, 41*b* have axle-like portions 42*a*, 42*b* which terminate in larger disk portions 44*a*, 44*b* which extend towards each other from rear fins 47*a*, 47*b* of the arms 33*a*, 33*b*. The rear fins are coupled to the upper shroud portion 34 via oppositely extending wings 46*a*, 46*b* of the upper shroud portion which form windows 43*a*, 43*b* between them and the fins. The trunnions 41*a*, 41*b* engage or snap into a rear portion of the valve body 50 so that the entire trigger shroud 30 can pivot relative to the body. Thus, pushing backward on the trigger 32 will cause the trigger shroud 30 to pivot about the rear trunnions 41*a*, 41*b* slightly downward, which will in turn cause the actuation ribs 35 to depress the pump diaphragm 20 (as shown hereinafter with respect to FIGS. 4*c* and 4*d*). When the trigger is released, the elasticity of the pump diaphragm 20 will cause movement of the trigger shroud back to its at-rest position.

Figure 4A:
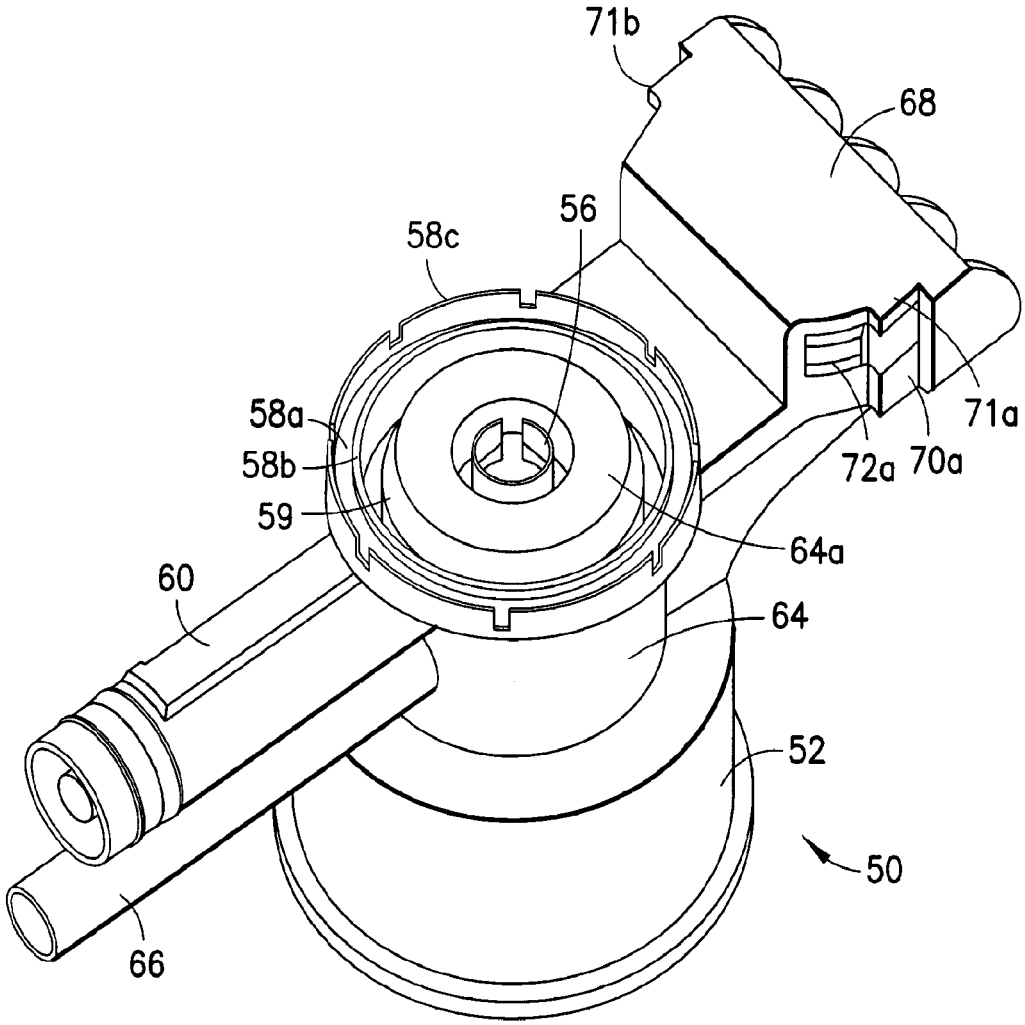
FIG. 4*a* is a perspective view of a first embodiment of the valve body of FIG. 1*c*.

A first embodiment of the molded body 50 of the invention is seen in FIGS. 4*a* and 4*c*-4*i*. Broadly, molded body 50 has a closure 52 (FIG. 4*a*) for a container (not shown), a fluid inlet 54 (FIG. 4*c*) which receives the dip tube 12, a valve seat 56 which receives the ball valve 14, engaging elements 58*a*, 58*b* for engaging the grooves 27, 29 of the circumferential flange 22 of the flexible diaphragm 20, a hollow fluid discharge barrel 60 having a proximal opening 62 into which the valve lip 24 of the pump diaphragm 20 seats, a hollow vent chamber 64, a hollow vent barrel 66 (FIG. 4*d*) coupling the vent chamber to the ambient atmosphere, a rear body section 68 (FIGS. 4*a*, 4*b*) having elements 70*a*, 71*a*, 72*a*, 70*b*, 71*b*, 72*b* (see FIGS. 4*a* and 4*j*) for coupling to the rear mating elements (trunnions) of the trigger shroud 30 so that the shroud can pivot at the coupling point, and forward mating elements 75*a*, 75*b* (FIG. 4*e*) for mating with and holding the combination nozzle door 80. Molded body 50 is preferably molded from polypropylene, although other materials could be utilized such as by way of example only and not by way of limitation high density polyethylene (HDPE). More particularly, the external features of the body 50 are seen best with reference to FIG. 4*a*, while the internal features are seen with reference to FIGS. 4*c*-4*j*. As seen in FIG. 4*a*, the bottom of body 50 comprises a closure 52. The internal features of the closure 52 are not shown but may include threads, bayonet locks, or any snap-on, threaded or other closure mechanism which will serve to attach the body 50 to a container which contains fluid in a fluid-tight manner. Above the closure 52 is the outer wall of the vent chamber 64. Communicating with the vent chamber 64 is the hollow vent barrel 66 which preferably extends beyond the end of the fluid barrel 60 in the direction of the nozzle. Above the vent chamber 64 is a diaphragm receiving section. The top 64*a* of the vent chamber 64 and the internal wall of finger 58*a* define a well 59 which receives the skirt valve 24 of the diaphragm. The fluid barrel 60 is in communication with one side of well 59 via the previously mentioned opening 62. External to the well 59 are the fingers or retaining elements 58*a*, 58*b*, and 58*c* which hold the diaphragm in place. Internal to the well is the valve seat 56 having ball-retention features which are described in more detail hereinafter with reference to FIG. 4*c*. On the other side of the body 50 relative to the fluid barrel 60 and the vent barrel 66, the body has a section 68 which includes elements mating elements 70*a*-72*a*, 70*b*-72*b* which mate with the trunnions 41*a*, 41*b* of the trigger shroud 30. These elements prevent the shroud from being removed from the body, but permit rotation of the shroud relative to the body.

Figure 4B:
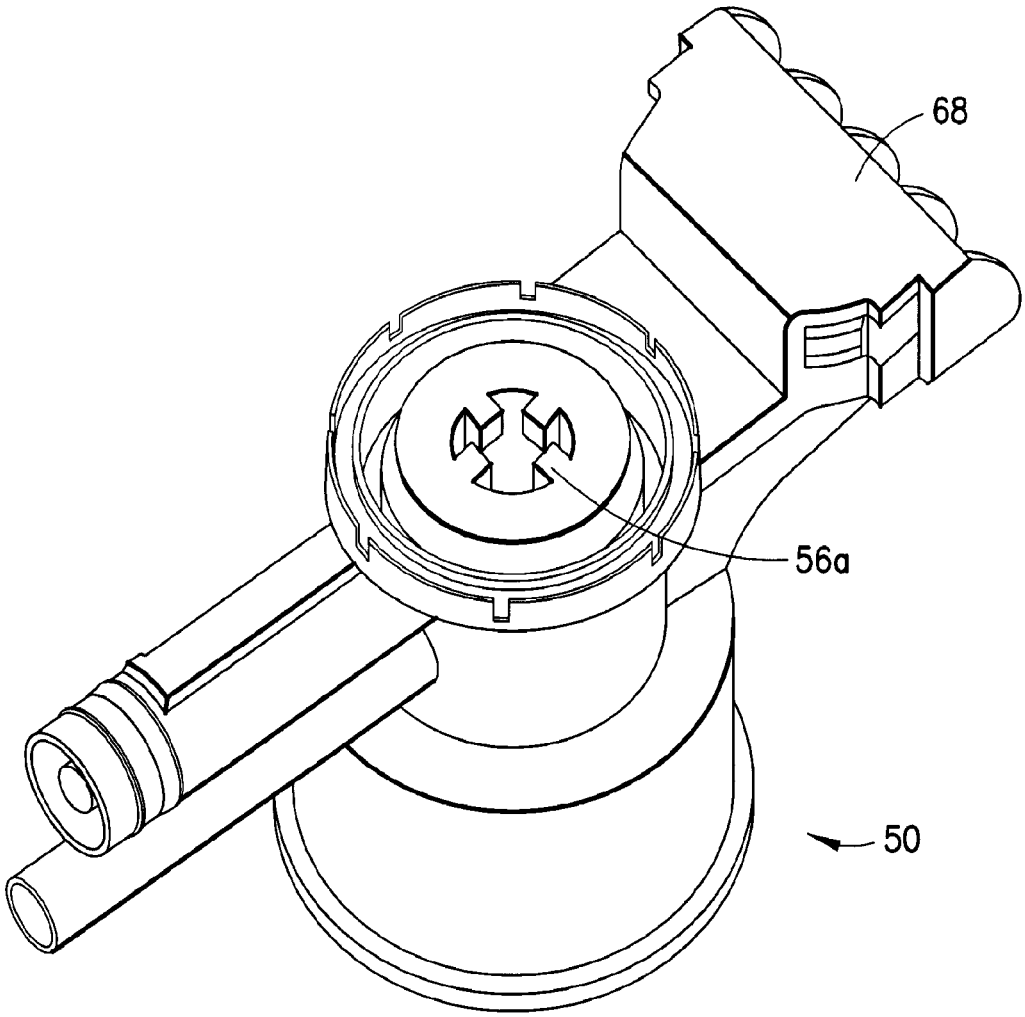
FIG. 4*b* is a perspective view of a second embodiment of the valve body of FIG. 1*c*.

A second embodiment of the body is seen in FIG. 4*b*, where like numbers relate to like parts. The only difference between the body 50*a* of FIG. 4*b* and the body 50 of FIG. 4*a* is that the valve seat 56*a* is formed differently. Whereas the valve seat 56 of body 50 involves molding four undercut retention fingers (discussed with reference to FIGS. 4*c* and 4*d*), the valve seat 56*a* is formed by a simple core pull with no undercuts and requires a secondary operation to skive or peel down four retention fingers substantially the same as those shown in FIGS. 4*c* and 4*d*.

Figure 4C:
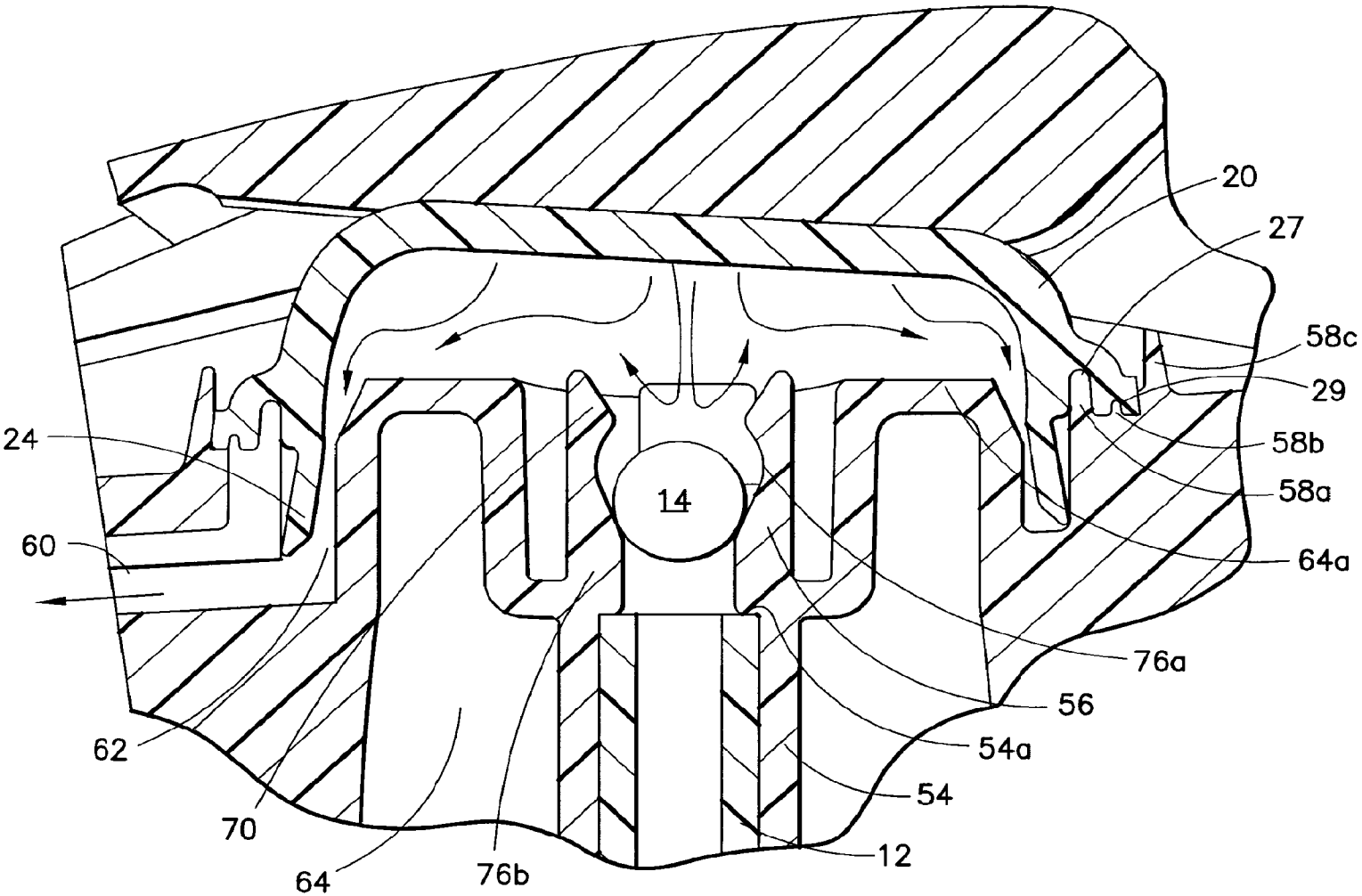
FIG. 4*c* is a broken cross-sectional perspective view of a central portion of the valve body of FIG. 1*c* in conjunction with the diaphragm, the ball valve and the dip tube and the trigger shroud during a spraying portion of the cycle.
Figure 4D:
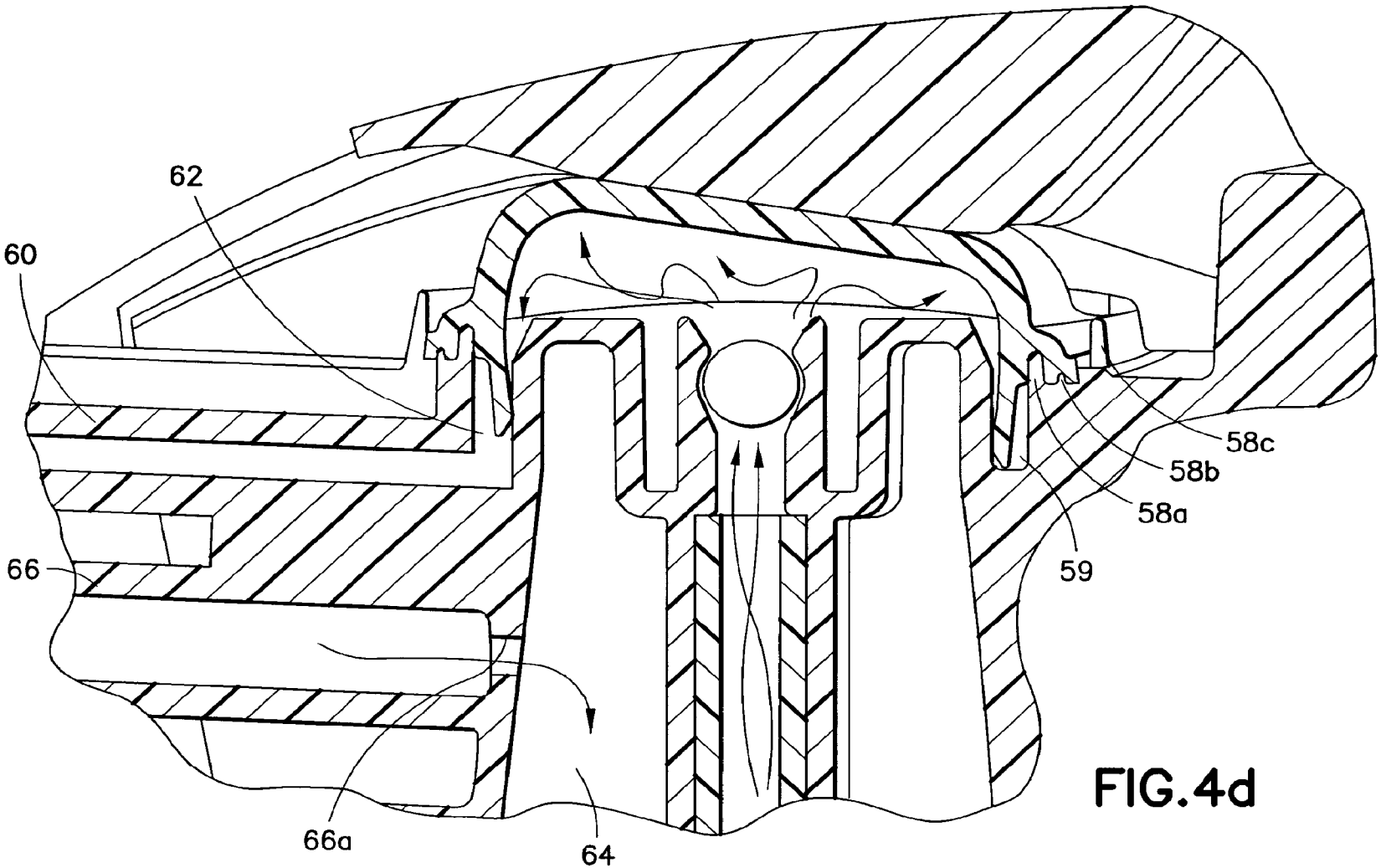
FIG. 4*d* is a broken cross-sectional perspective view of a central portion of the valve body of FIG. 1*c* in conjunction with the diaphragm, the ball valve and the dip tube and the trigger shroud during an intake portion of the cycle.
Figure 4E:
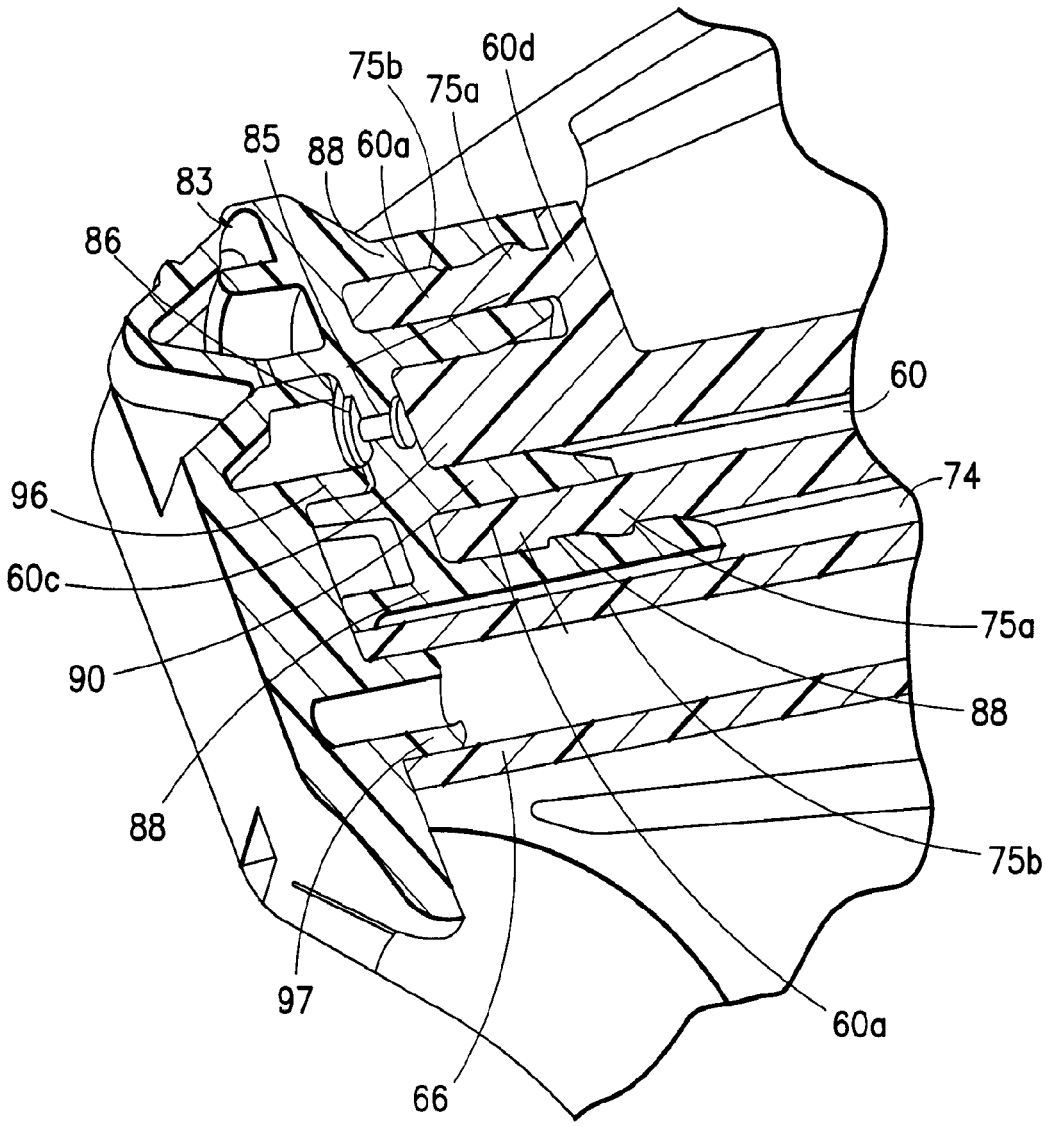
FIG. 4*e* is a broken cross-sectional perspective view of the nozzle end portion of the valve body of FIG. 1*c* in conjunction with the combination nozzle-door and the trigger shroud.

Turning now to FIGS. 4*c* and 4*d*, certain internal features of body 50 are seen. In particular, a fluid inlet 54 having dip tube 12 is shown with a seat or stop 54*a* for the tube 12 which also forms the start of the valve seat 56. Valve seat 56 includes arms 76 with undercuts 76*a* and top prongs 76*b*. The prongs 76*b* are flexible to permit the ball 14 to be pushed therethrough and into the undercut arm section during assembly. The undercuts and prongs are sized and shaped to receive the ball valve 14. In a fluid intake position (FIG. 4*d*), the ball is lifted off of seat 56 and a fluid path is established between the arms (see FIG. 4*a*), whereas in a fluid outflow (spraying) position (FIG. 4*c*), the ball 14 is seated in seat 56 where it blocks fluid flow through dip tube 12. As seen in FIG. 4*d*, during fluid intake, air passes from the vent barrel 66 to the vent chamber 64 via hole 66*a* which is perpendicular to chamber 64.

Details of the internal structure of the nozzle end of the body 50 are seen best with reference to FIGS. 4*e*-4*i*. The nozzle end of the body 50 is seen with the walls of hollow fluid barrel 60 and hollow vent barrel 66 defining a space therebetween 74 (see also FIG. 1*c* where the space is unnumbered). The distal end of the outer surface of fluid barrel 60 is shown with a wall 60*a* having mating structure or ribs 75*a*, 75*b* which extend into space 74 and are used to mate with structure on the combination door nozzle 80. The distal end of the fluid barrel 60 is also shown with walls 60*c* and 60*d*. Wall 60*c* is an enlarged solid cylindrical wall which as discussed hereinafter with reference to FIGS. 4*f*-4*i* has channels 60*e* which define two fluid paths to an outlet. Wall 60*d* is a supporting wall for a portion of wall 60*a* which forms a circle around wall 60*c* (see FIG. 4*f*).

Figure 4G:
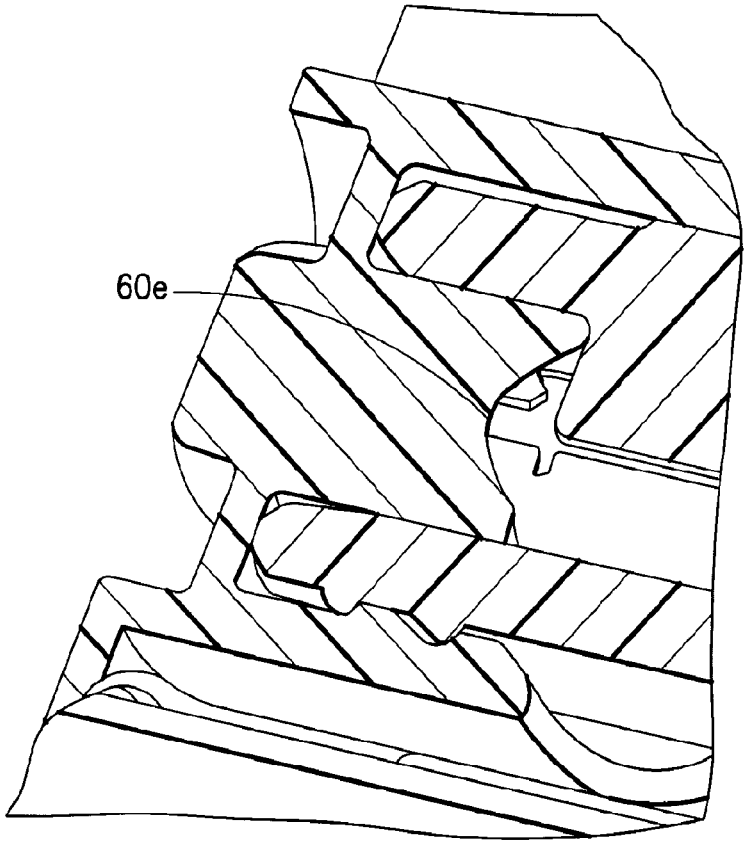
FIG. 4*g* is an offset cross-sectional perspective view of the nozzle end portion of the valve body of FIG. 1*c* in conjunction with the combination nozzle-door showing the fluid pathway through the valve body.
Figure 4F:
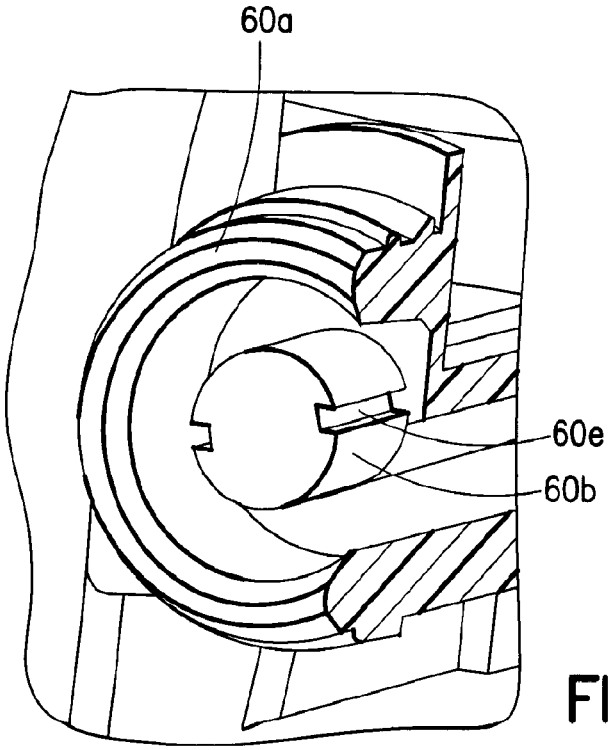
FIG. 4*f* is a cut-away perspective view of the nozzle end portion of the valve body of FIG. 1*c* showing the fluid pathway through the valve body.
Figure 4H:
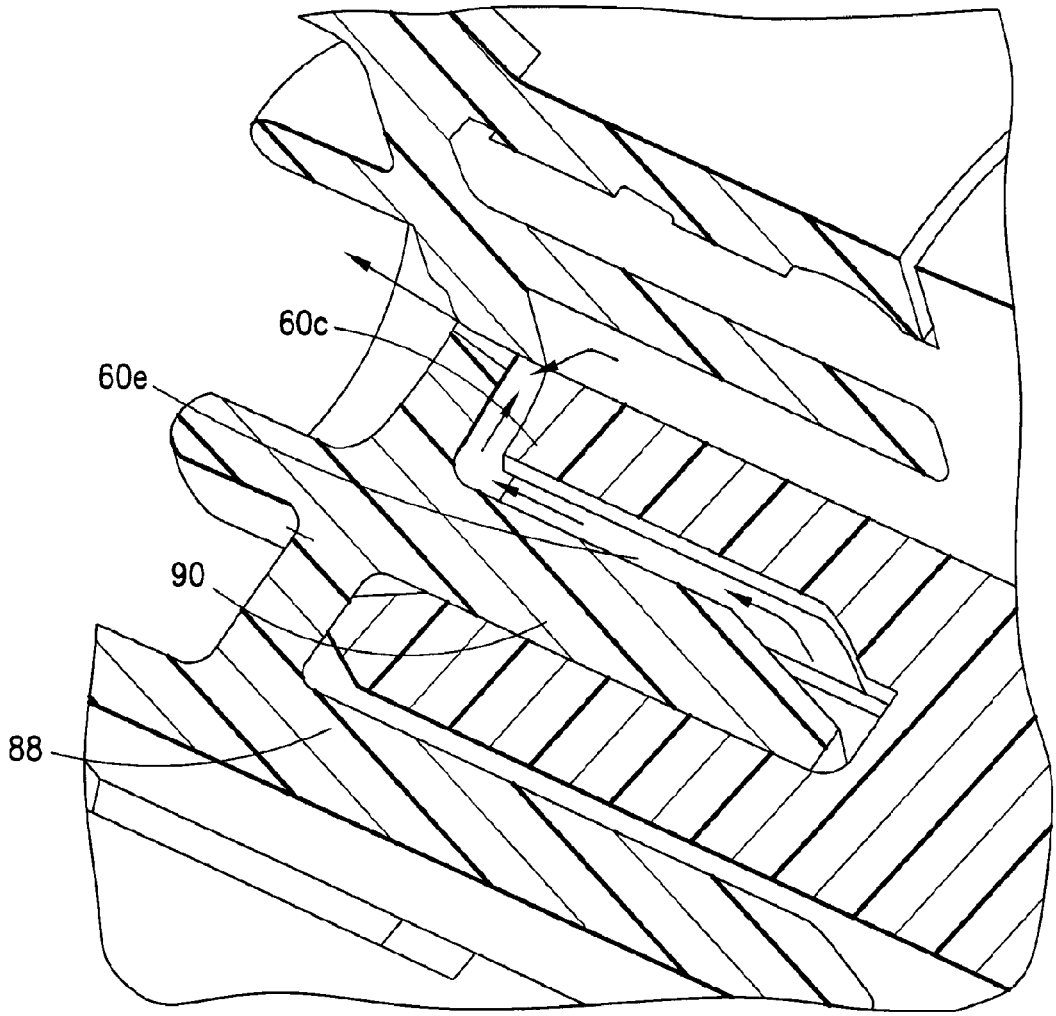
FIG. 4*h* is a cut-away perspective view of the nozzle end portion of the valve body of FIG. 1*c* in conjunction with the combination nozzle-door showing the fluid pathway through the valve body.
Figure 4I:
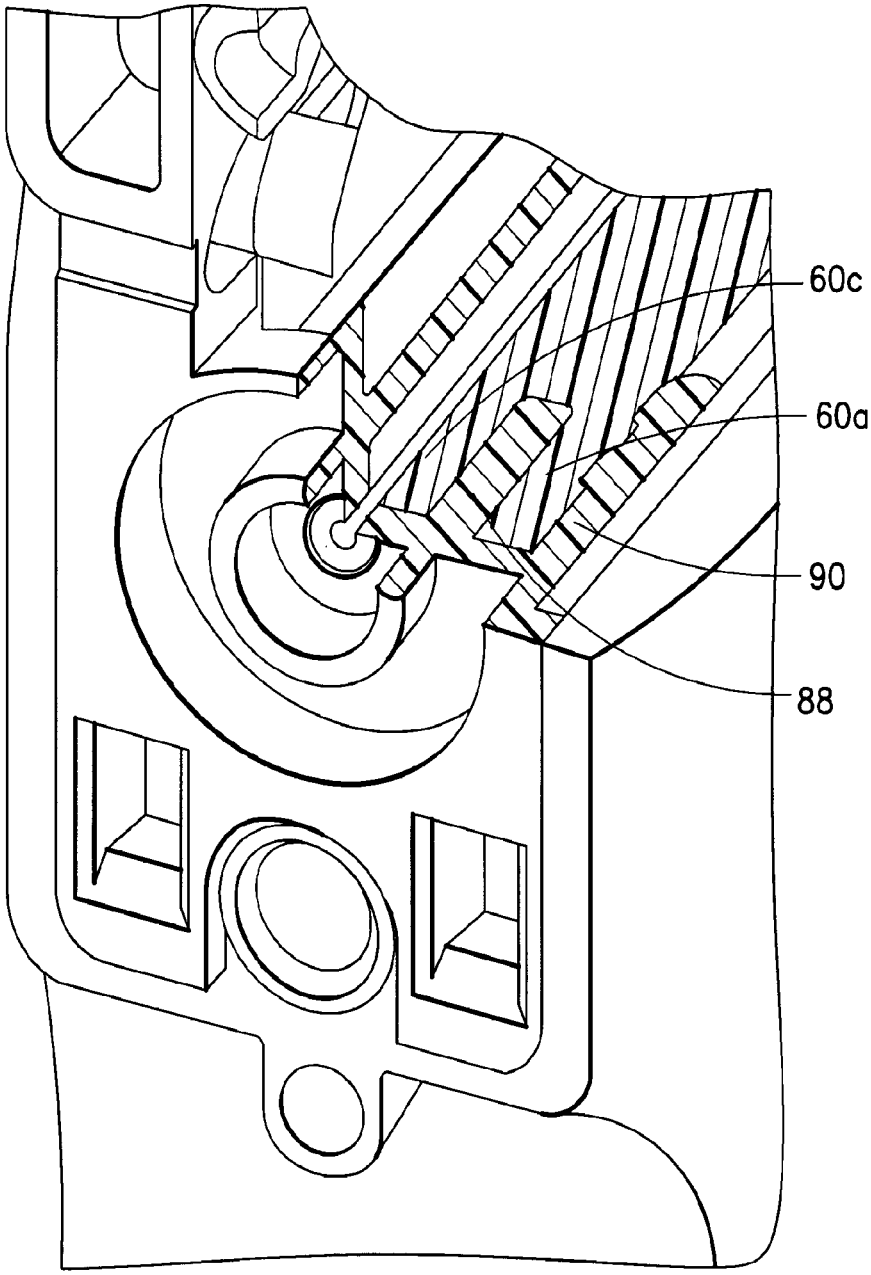
FIG. 4*i* is a perspective view cut across two planes of the nozzle end portion of the valve body of FIG. 1*c* in conjunction with the combination nozzle-door.

As seen best in FIGS. 4*f*, 4*g*, and 4*h*, wall 60*c* is provided with molded grooves, paths or channels 60*e* which direct fluid from the fluid barrel 60 up the sides of solid cylindrical wall 60*c*. The channels 60*e* in the front face 60*b* of wall 60*c* effectively constitute a fluid outlet out of the body 50 and into the nozzle portion of the nozzle door 80 as described hereinafter with reference to FIGS. 5*a*-5*c*.

Figure 4J:
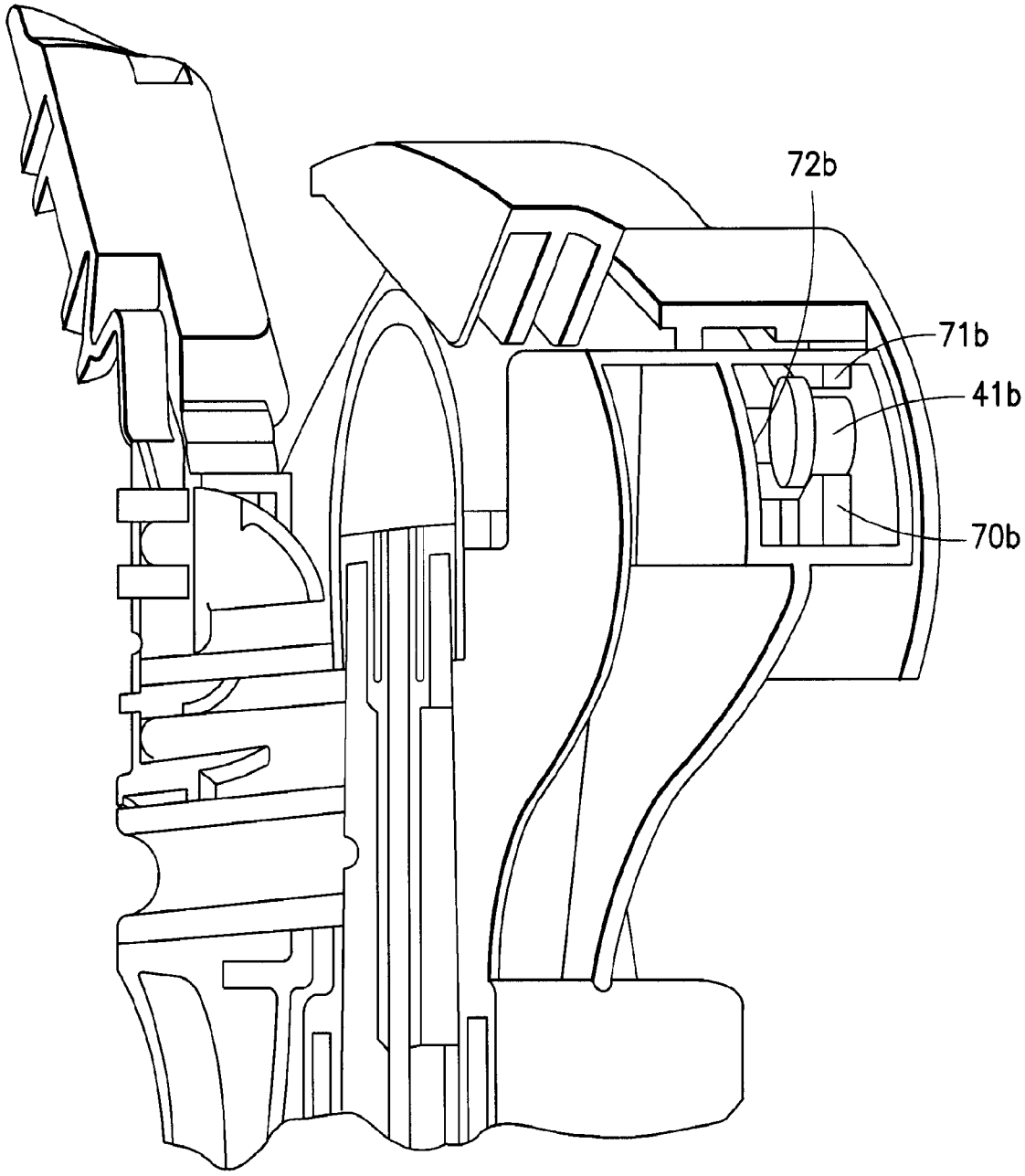
FIG. 4*j* is a rear perspective view of the trigger sprayer of FIG. 1*d* cut lengthwise in half.

Turning now to FIG. 4*j* in conjunction with FIGS. 1*b* and 4*a*, the rear portion 68 (FIG. 4*a*) of body 50 is seen. The rear portion 68 is provided with internal wall structures 70*a*, 70*b*, 71*a*, 71*b*, 72*a*, 72*b* which receive and mate with the trunnions 41*a*, 41*b* of the trigger shroud 30 so that the trigger shroud 30 cannot be easily detached from the body 50, but is able to rotate relative to the body. Wall structures 70*a*, 71*a* and 70*b*, 71*b* extend below and above the axle portions 42*a*, 42*b* of the trunnions, and define a space which is narrower than the diameter of the disks 44*a* 44*b*, thereby preventing the trunnions from pulling out. Axles 42*a* and 42*b* are free to rotate on walls 70*a*, 70*b*. Wall structures 72*a* and 72*b* are flexible walls which permit the trunnions to be forced past them during assembly, and then act as front stops for the axles, thereby preventing the trunnions from pulling out in a forward direction.

Figure 5A:
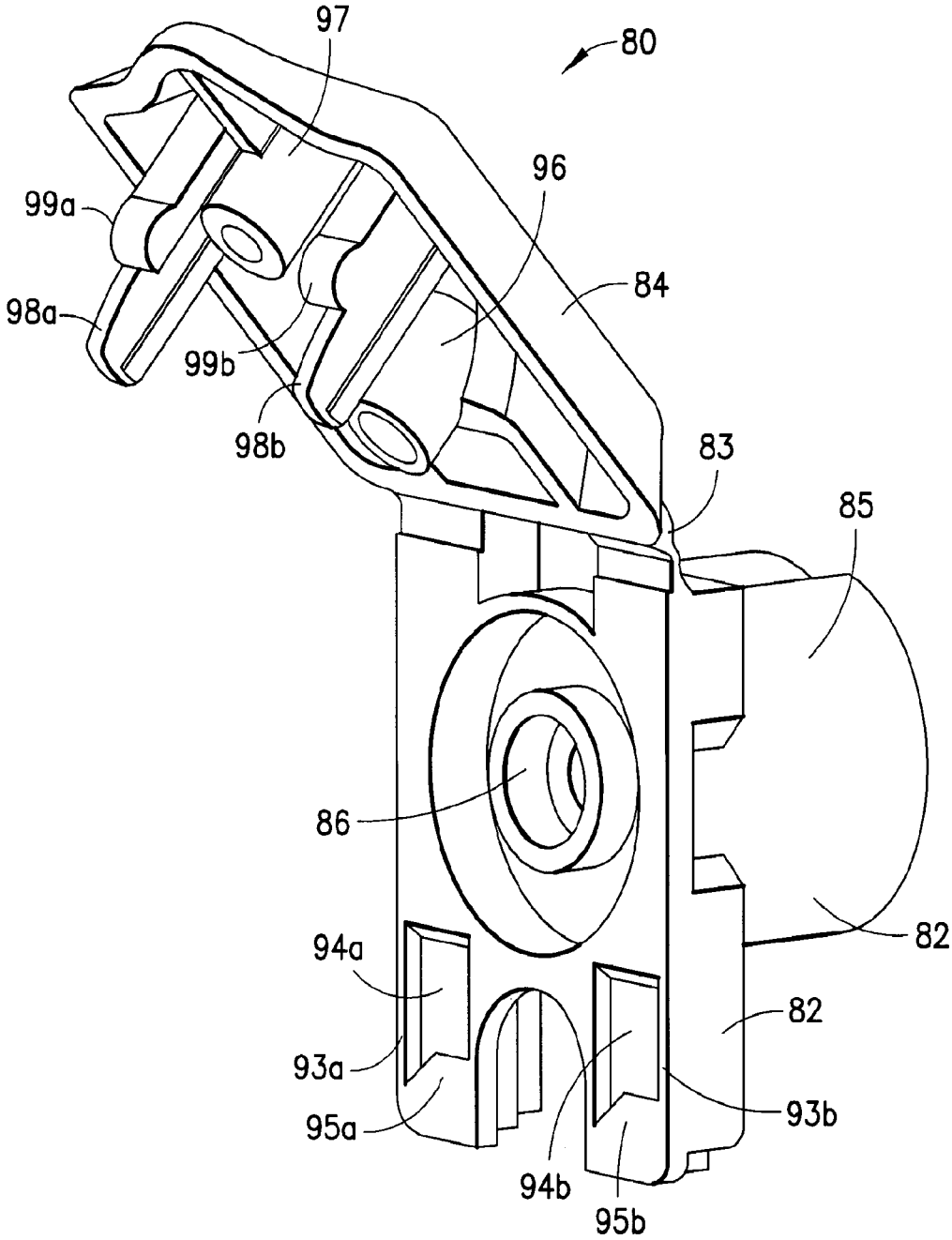
FIG. 5*a* is a front perspective view of the combination nozzle-door of FIG. 1*c* in an open position.
Figure 5B:
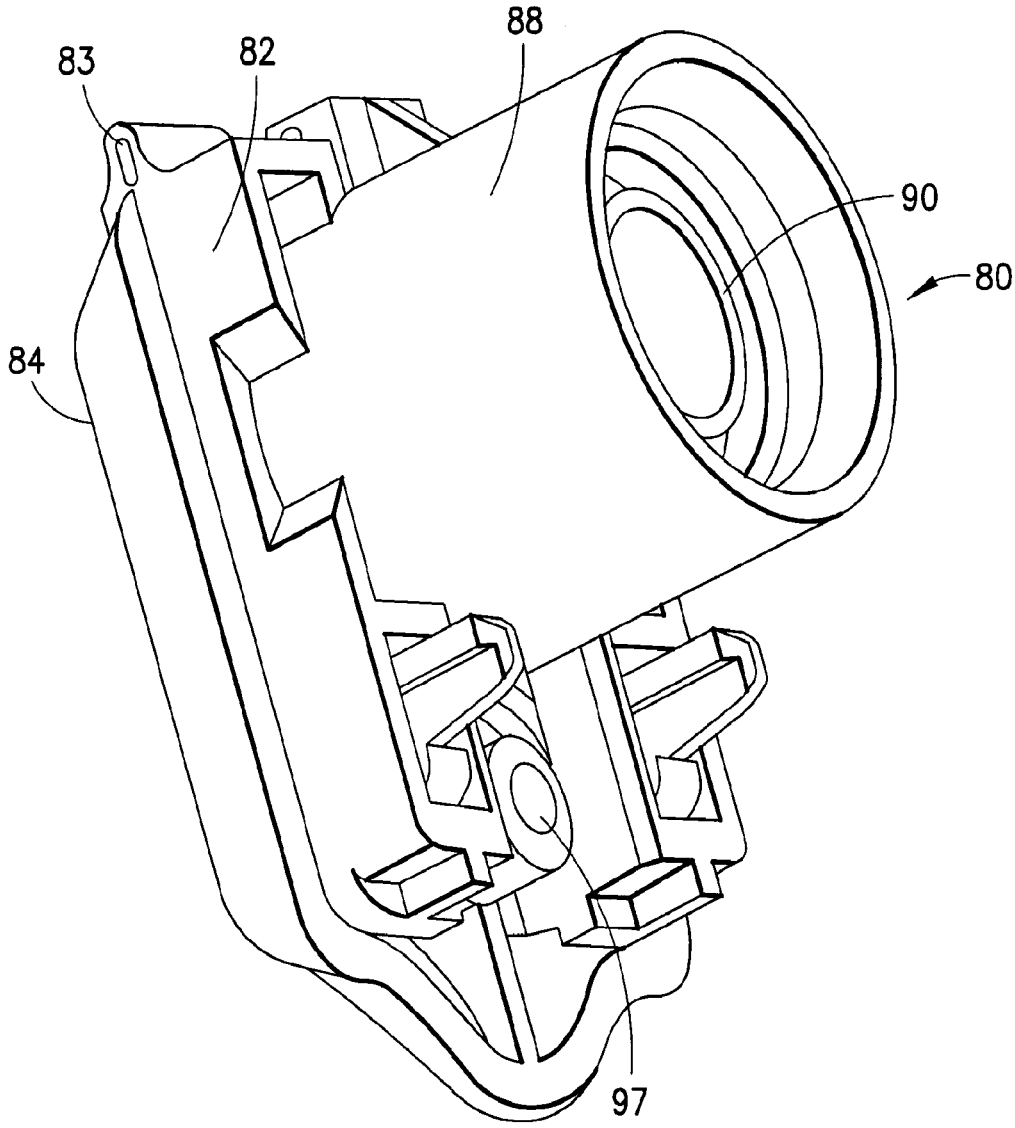
FIG. 5*b* is a rear perspective view of the combination nozzle-door of FIG. 1*c* in a closed position.
Figure 5C:
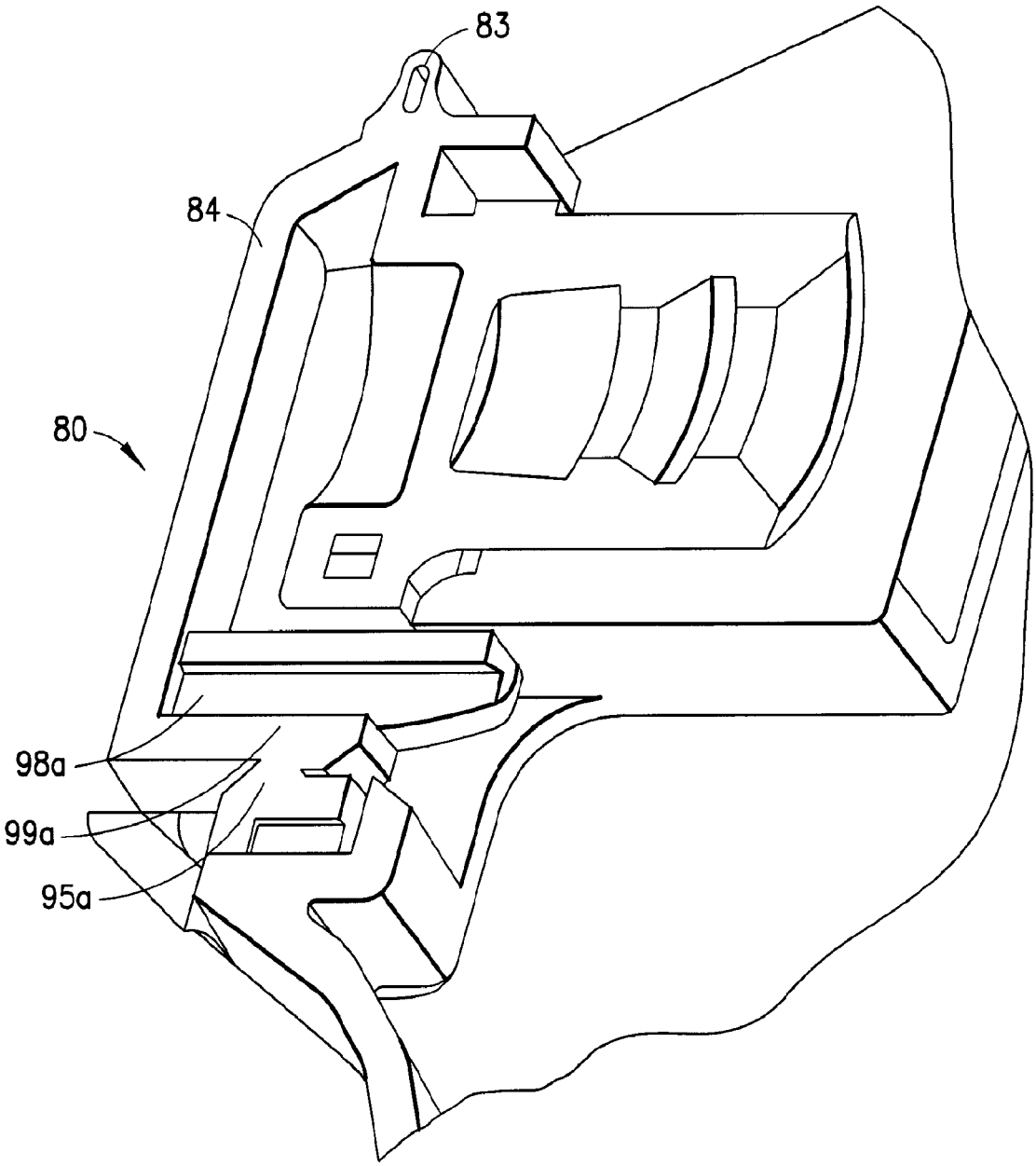
FIG. 5*c* is a broken cross-sectional perspective view of the combination nozzle-door of FIG. 1*c* with the trigger lock engaging the trigger.

Turning now to FIGS. 5*a*-5*c*, the molded combination nozzle and door assembly 80 is seen. The combination nozzle and door assembly is preferably made from HDPE, although other materials could be utilized such as by way of example only and not by way of limitation polypropylene, and has a first portion 82 which includes the nozzle and various mating elements which mate to the body 50, a live hinge 83 and a second door portion 84 which includes various plugs and trigger locking elements. More particularly, and as seen in conjunction with FIGS. 1*d* and 4*e*, 4*h* and 4*i*, first portion 82 includes a nozzle 85 which abuts the fluid outlet path 60*e* of the body 50 with optional spin mechanics (not shown) and a nozzle opening 86. The first portion 82 also includes an outer mating wall 88 which engages the outside of body wall 60*a*. Outer mating wall 88 has ribs which engage the mating ribs 75*a*, 75*b* of body wall 60*a*, and seen in FIG. 4*e*, the top of the outer mating wall 88 is notched (i.e., it is shorter in cross-section) so as to key its location, as wall 60*d* of body 50 acts as a stop in the notch. The first portion 82 further includes an inner mating wall 90 which engages and plugs the fluid barrel 60, thereby forcing fluid to enter the fluid paths 60*e* as previously described. Walls 88 and 90 assure that the combination nozzle and door assembly are fixed to the body 50. Finally, the first portion 82 includes walls 93*a*, 93*b* which define windows 94*a*, 94*b* and bosses 95*a*, 95*b* for releasably holding trigger lock bars of the door portion 84.

The door portion 84 is hinged to the first portion 82 by live hinge 83 and is free to move relative thereto. The door portion 84 includes a nozzle plug 96, a vent plug 97, and trigger lock bars 98*a*, 98*b* each having a protrusion 99*a*, 99*b* for engaging the bosses 95*a*, 95*b*. More particularly nozzle plug 96 is seen to be a hollow plug with an end wall. When the door is closed, the nozzle plug 96 fits inside the nozzle 85 of the first portion 82 in order to block fluid from exiting the sprayer. Similarly, vent plug 96 is seen to be a hollow plug with an end wall. When the door is closed, the vent plug 96 fits inside the hollow vent barrel 66 of the body 50 and thereby prevents fluid from exiting from the bottle via the vent chamber and vent barrel. Trigger lock bars 98*a*, 98*b* are formed such that when the door is closed, the trigger lock bars extend through the windows 94*a*, 94*b* of the first portion 82 of the combination nozzle and door assembly 80, and into the trigger lock windows 37*a*, 37*b* (FIG. 3*c*, 3*d*) of the trigger shroud, thereby locking the trigger shroud relative to the combination nozzle and door assembly 80 and the body 50. This prevents accidental actuation of the trigger.

With the provided elements of the trigger sprayer, assembly may be accomplished in five simple steps. Particularly, the ball 14 is pushed into the valve seat 56 by pushing the ball past prongs 76*b* of the valve seat. After the ball is inserted, the diaphragm 20 may be fixed in place on the body 50 with valve lip 24 in well 59, and with tongues 26, 28 of flange 22 extending between and engaging the engaging elements or walls 58*a*, 58*b*, 58*c* of the body 50. The trigger shroud is coupled to the body by forcing trunnions 41*a*, 41*b* past flexible wall structures 72*a*, 72*b* such that the axles 42*a*. 42*b* of the trunnions are captured by structures by walls 70*a*, 70*b*, 71*a*, 71*b*, 72*a*, 72*b*. At any time, the nozzle and door assembly 80 may be attached into the valve body 50 by pushing walls 88 and 90 into respective mating locations on the valve body. The door 84 of the nozzle and door assembly 80 may be either open or closed when the assembly 80 is attached to the body 50. If it is closed, the vent plug 97 will engage the vent barrel 66 during attachment, and the trigger lock bars 98*a*, 98*b* will engage the trigger lock windows 37*a*, 37*b*. Also, at any time, the dip tube 12 can be pushed into the inlet path 54 of the body 50.

There have been described and illustrated herein embodiments of a trigger sprayer and a method of assembly. While particular embodiments of the invention have been described, it is not intended that the invention be limited thereto, as it is intended that the invention be as broad in scope as the art will allow and that the specification be read likewise. Thus, while particular materials for molding certain elements of the invention have been disclosed, it will be appreciated that other materials or combinations of materials could be used as well. In addition, while particular types of latching and mating mechanisms have been disclosed, it will be understood other latching and mating mechanism could be used. Also, while the invention was described as preferably utilizing a ball-type valve, it will be recognized that a flapper valve or other type of valve could be utilized. In fact, it is possible to reduce the parts by one by forming a flapper valve on the sprayer end of the dip tube, or by forming the flapper valve as part of the body. In those situations it may be desirable to co-inject materials, or to use a post-molding process to generate the flapper valve. It will therefore be appreciated by those skilled in the art that yet other modifications could be made to the provided invention without deviating from its spirit and scope as claimed.

What is claimed is:

1. A trigger sprayer for use with a container of fluid, comprising:

a dip tube;

an inlet valve;

a molded flexible pump diaphragm having a circumferential flange and a valve lip;

a molded shroud which includes a trigger, an actuation element which engages said pump diaphragm, a front mating element, and a rear mating element;

a molded body having a closure for the container, a fluid inlet coupled to said dip tube, a coupling for said inlet valve, an engaging element for engaging said circumferential flange of said flexible diaphragm, a fluid discharge barrel having a proximal opening into which said valve lip of said pump diaphragm seats, a vent chamber, a vent barrel coupling said vent chamber to the ambient, a body section having a mating element for coupling to the rear mating element of the shroud so that the shroud can pivot at the coupling point, and a forward mating element; and a molded combination nozzle and door assembly with a nozzle which couples to said fluid discharge barrel of said molded body and a flange which mates with said forward mating element of said body, a live hinge, and a door having a first plug which plugs said nozzle, a second plug which plugs said vent barrel, and trigger locking elements which extend through said nozzle and door assembly and lockingly mate with said front mating element of said molded shroud in order to lock said trigger when said door is closed.

2. A trigger sprayer according to claim 1, wherein:

said inlet valve is a ball valve, and said coupling for said inlet valve is a valve seat.

3. A trigger sprayer according to claim 1, wherein:

said rear mating element comprises a trunnion.

4. A trigger sprayer element for use with a fluid container as well as a pump actuated by movement of a trigger, the trigger sprayer element comprising:

a molded body having a container closure;

a fluid inlet for receiving fluid from the container via an inlet valve;

an engaging element for the pump;

a fluid discharge barrel having a proximal opening coupled to the pump, said fluid discharge barrel carrying fluid supplied by the pump;

a vent chamber coupled to the fluid container;

a vent barrel coupling said vent chamber to the ambient, wherein said vent barrel is substantially parallel said fluid discharge barrel and extends beyond said fluid discharge barrel in a direction away from the container; and a unitary door assembly with a nozzle coupled to said fluid discharge barrel, means for closing said nozzle and means for locking the trigger.

5. A trigger sprayer for use with a container of fluid, comprising:

a pump;

a shroud which includes a trigger, an actuation element which engages said pump, a front mating element, and a rear mating element;

a closure for the container;

a body coupled to said pump and said shroud, and having a fluid discharge barrel with a proximal opening coupled to the pump, a vent chamber, a vent barrel coupling said vent chamber to the ambient, wherein said fluid discharge barrel carries fluid supplied by said pump;

a nozzle coupled to said body; and a unitary door assembly with a means for plugging said nozzle, means for plugging said vent barrel and means for locking said trigger.

6. A trigger sprayer for use with a container of fluid, comprising:

a pump;

a trigger which actuates said pump;

a body coupled to said pump and said trigger, said trigger moving relative to said body;

a nozzle coupled to said body; and a unitary door assembly, with means for closing said nozzle and trigger locking elements which extend through said nozzle and said door assembly and lockingly mate with a front mating element of a molded shroud to lock said trigger when said door is closed.

7. A trigger sprayer according to claim 1, wherein:

said pump diaphragm is substantially hemispherical.

8. A trigger sprayer according to claim 1, wherein:

said shroud has integral means for engaging said pump diaphragm.

9. A trigger sprayer according to claim 1, wherein:

said body includes an integral closure for attaching to a fluid container.

* * * * *